US005944911A

United States Patent [19]

Winters et al.

[11] Patent Number: 5,944,911

[45] Date of Patent: Aug. 31, 1999

[54] METHOD AND APPARATUS FOR SWEEPING SEATING AREAS

[75] Inventors: Robert L. Winters, Lenexa; Thomas P. Wagner, Olathe, both of Kans.

[73] Assignee: Winters Company, Lenexa, Kans.

[21] Appl. No.: 08/881,838

[22] Filed: Jun. 25, 1997

[51] Int. Cl.[6] ..... A47L 5/14

[52] U.S. Cl. ..... 134/37; 15/405; 15/409; 239/288.3; 239/291; 239/532; 239/DIG. 21

[58] Field of Search ..... 15/405, 409; 134/37; 239/288.3, 291, 532, DIG. 21

[56] References Cited

U.S. PATENT DOCUMENTS

| | | | |
|---|---|---|---|
| 1,399,165 | 12/1921 | Spencer | 15/330 |
| 2,289,889 | 7/1942 | Stick et al. | 15/405 X |
| 2,586,145 | 2/1952 | Breuer et al. | 15/405 X |
| 3,938,218 | 2/1976 | DeAmicis | 15/405 X |
| 4,360,949 | 11/1982 | Wilson | 15/405 |
| 4,867,380 | 9/1989 | Sibbertsen | 239/DIG. 21 |
| 5,133,105 | 7/1992 | Littlefield | 15/405 |
| 5,238,585 | 8/1993 | Reed | 15/409 X |
| 5,332,222 | 7/1994 | Perry | 15/405 X |
| 5,671,889 | 9/1997 | Petty | 239/532 X |

OTHER PUBLICATIONS

BoxOffice Business Magazine coverpage and p. 171 entitled *ShoWest 1997 New Products Guide* Dated: Apr. 1997; 2pgs.

Exair–Mail Brochure No. 30; published by Exair Corporation; Dated: Winter 1996–97.

*Primary Examiner*—Chris K. Moore

*Attorney, Agent, or Firm*—Hovey, Williams, Timmons & Collins

[57] ABSTRACT

A method and apparatus for sweeping seating areas is provided which enables the operator to stand substantially upright while directing a stream of air substantially horizontally along the floor supporting the seats. The apparatus includes a handle adapted for connection to a source of compressed air, a substantially elongated wand connected to the handle, and a nozzle which directs a stream of air along the floor substantially perpendicular to the wand. The nozzle is configured to intake additional air besides the compressed air supplied through the handle to provide increased air volume at pressures reduced from that supplied by the compressed air source. The method includes positioning the apparatus behind seats, particularly in stair-stepped stadium seating areas to provide a substantially horizontal air flow reaching into corners between the riser wall and landing of the seating area and around the bottoms of the seats.

11 Claims, 1 Drawing Sheet

10
12
14
16
18
20
21
22
24
26
28
30
32
34
35
36
38
40
42
44
46
48
50
52
54
56
58
60
62
64
66
68
70
72
74
76
80
82
84
86
88
90
92
94
96
98
100
102
104

METHOD AND APPARATUS FOR SWEEPING SEATING AREAS

BACKGROUND OF THE INVENTION

1. Field of the Invention

This application concerns an improved method and device for sweeping seating areas using pressurized air. More particularly, it is concerned with a hand held sweeper with a directional nozzle which concentrates a focused stream of pressurized air from a wand which is capable of reaching areas of limited access in and around seating, particularly in stadium-type seating.

2. Description of the Prior Art

The use of vacuum cleaners in homes and commercial buildings is a well known method of cleaning soil and solid debris. While these cleaners do a good job, cleaning large areas such as movie theatres necessitates more efficient methods and the presence of large numbers of seats and other obstacles, the inability to generate a sufficient air flow to pick up many items, the inability to pick up and collect large items such as cups and lids which become stuck in vacuum intakes, and the volume of accumulated debris makes the use of vacuum cleaners in such areas problematic.

As a result, many have turned to the practice of blowing debris to a collection area in large seating areas such as movie theatres, indoor arenas or outdoor stadiums. This practice typically involves the use of large "leaf blower" type devices which generate large volumes of air. One disadvantage of such devices is that they are relatively heavy and fatigue the operator. Another disadvantage is the tendency to stir up dust which collects on the seats and even worse, on the movie screen. Another problem is the inability to get behind seats in tight areas, particularly where stadium seating is present. In stadium seating, the seats are connected to the floor on separate horizontal floor surfaces of progressively greater height, presenting a small wall behind each seat and thus a small clearance between the seat and the wall. The "leaf blower" type devices are incapable of passing between the seat and the wall, resulting in a high angle of attack between the air flow stream and the floor and increased turbulence causing excessive dust distribution.

As a result, there has developed a need for a new and improved method and device for sweeping seating areas which is lightweight and convenient to use, generates a sufficient volume of air to move the debris to a collection area, minimizes turbulence and dust distribution, and can be positioned in hard-to-reach areas of minimum clearance.

SUMMARY OF THE INVENTION

These problems have largely been solved by the method and apparatus for sweeping seating areas hereof. That is to say, the device hereof is simple to use, light in weight and easy to carry, capable of positioning in areas of narrow clearance, and generates sufficient air volume to move debris such as popcorn, toothpicks, cups and the like by using a confined stream of air which minimizes scattering of dust.

Broadly speaking, the device hereof uses a handle, a wand, and a nozzle positioned at the end of the wand which directs a confined stream of air in a direction generally perpendicular to the axis of the wand. The handle includes a control for activating the control of air, and is connected to a conduit carrying pressurized air. The handle control may include a trigger and a trigger lock for keeping the trigger in an engaged position without the need for the operator to squeeze the trigger. The wand is a rigid, narrow tubular member which connects the nozzle and the handle. In an improved embodiment of the invention, the wand presents a bend which facilitates placement of the nozzle between the back of a seat and the wall or step of a stadium seating area.

The nozzle hereof is configured to induce additional air flow generated by the flow of pressurized air from the wand. To that end, each end of the nozzle is open, with an intake end presenting an inwardly narrowing frustoconical interior configuration and the port for the flow of pressurized air from the wand being located downstream from the fusto-conical interior to induce additional air to flow through the nozzle. The nozzle is further preferably provided with a shroud for protecting the nozzle from damage caused by contact with the seats, the floor and other structures.

The improved method as broadly defined includes the steps of providing an apparatus having a thin wand and a nozzle at one end behind a seat and moving the wand behind the seats in a row with the flow of air oriented substantially along the back of the row, and directing a flow of pressurized air behind the seats to move debris in the direction of movement of the nozzle. More particularly, the method is presented in conjunction with a stadium seating area, where the nozzle is directed substantially between the seats and the upstanding wall with the wand positioned behind the seats.

As a result of the invention hereof, it is possible for an operator to quickly clean a large area with numerous obstacles such as seats in a relatively short period of time with reduced fatigue. The wand directs a stream of air in a substantially horizontal plane and locates the stream in immediate proximity to the debris to be swept. The operator need not bend over or stoop to gain access to the area beneath or behind the seats. Areas behind the seats in stadium seating are now accessible and receive a more thorough cleaning. Moreover, the dust and other small particles are less likely to be lifted into the air and deposited on other areas such as movie screens, thereby reducing follow-on cleaning of those surfaces.

These and other benefits of the present invention will be apparent to those skilled in the art with reference to the drawings and description which follow.

DESCRIPTION OF THE PREFERRED EMBODIMENT

Figures 1, 2, 3, 4:
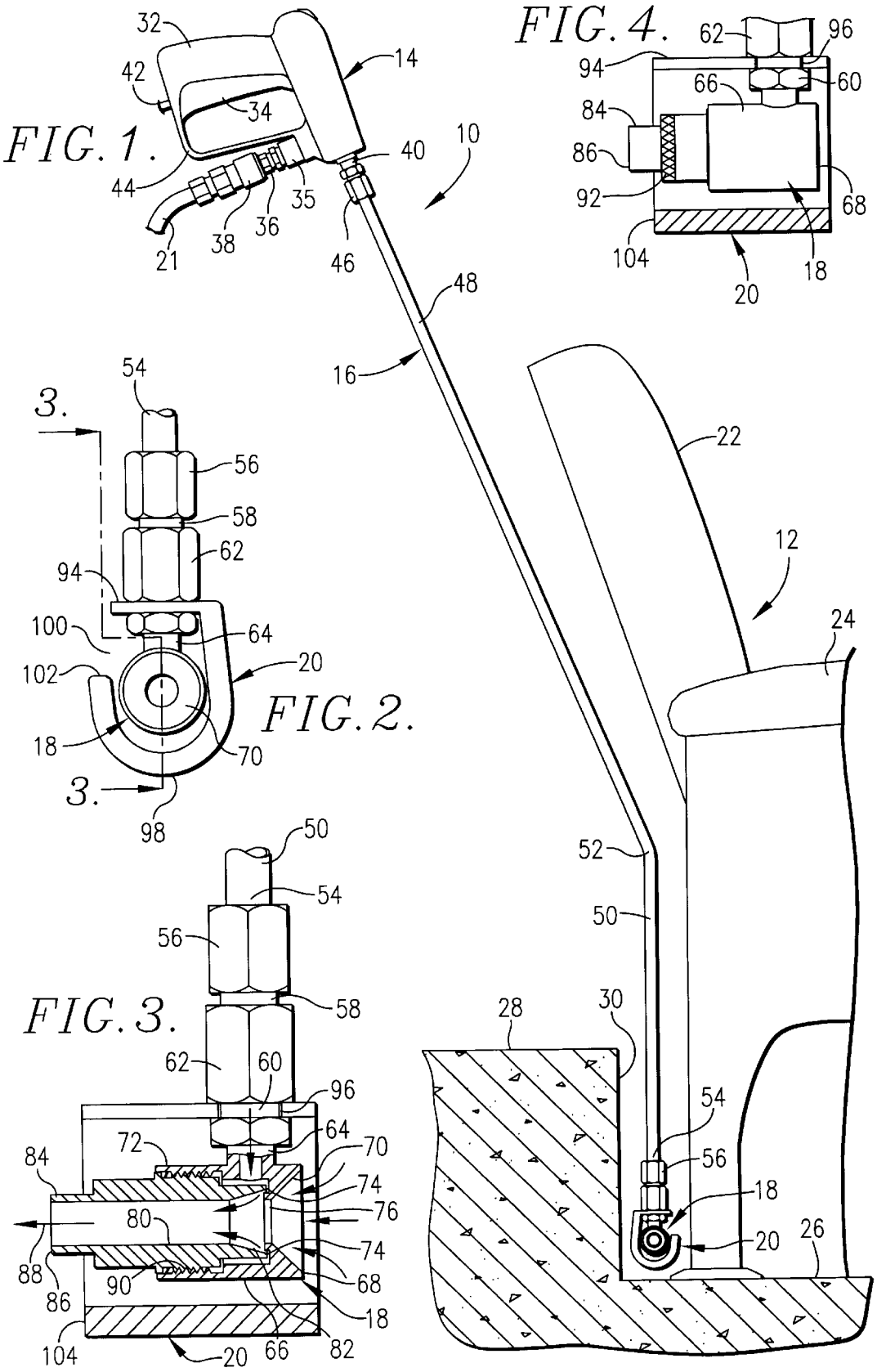
FIG. 1 is a vertical elevational view of the preferred embodiment of the apparatus for sweeping seating areas in accordance with the present invention, showing the wand and nozzle positioned behind a seat in a stadium seating arrangement.
FIG. 2 is an enlarged fragmentary front elevational view showing the nozzle of the apparatus hereof, showing the intake end and the protective shroud around the nozzle.
FIG. 3 is an enlarged fragmentary side elevational view showing the nozzle of the apparatus in partial vertical cross-section taken through line 3—3 of FIG. 2, showing the directional insert for the nozzle, the inlet from the wand into the nozzle, and arrows indicating the direction of flow.
FIG. 4 is an enlarged fragmentary side elevational view showing the nozzle with portions of the shroud removed.

Referring now to the drawing, FIG. 1 shows the apparatus 10 for use in sweeping seating areas 12 which includes a handle 14, a wand 16, a nozzle 18 and a shroud 20. The handle 14 is coupled to a flexible conduit 21 which carries pressurized air from a remote source such as a tank or air compressor. The seating areas 12 include rows 22 of a plurality of substantially linearly aligned seats 24 positioned on first lower landing 26, it being understood that a second row of seats 24 would normally be located on a second upper landing 28 with the second landing 28 being elevated relative to first landing 26 by riser wall 30. In this arrangement, known in the trade as stadium seating, the first and second landings are normally substantially planar and horizontal. However, the apparatus hereof is also useful for seating areas where the supporting surface is not stair-stepped as in stadium seating but rather inclined and substantially planar.

In greater detail, the handle 14 includes a pistol grip 32 provided with a spring-loaded trigger 34 for actuating and regulating the flow of air into the handle. The handle 14 further includes an inlet 35 with a quick-connect fitting 36 for receiving thereon the quick-connect female coupler 38 of conduit 21. The handle includes an outlet 40 for discharging air to the wand 16. One handle 14 useful in the present application is designed for use in self-service car wash applications such as Hypro model HP 17 rated at 2155 psi, 210 degrees Fahrenheit and 7 U.S. gallons per minute (180 bar, 100 degrees Centigrade and 25 liters/minute). A stop 42, such as a rivet or the like, may be passed through the trigger guard 44 of the handle 14 to keep the trigger 34 depressed to maintain the flow of air during use.

The outlet 40 of the handle 14 is externally threaded and connected to wand 16 by flare nut 46 on wand 16. The wand 16 is elongated and tubular, preferably presenting an outside diameter no greater than ½ inch in order to reach between narrow clearances between the seat and the riser wall. The wand 16 is provided with an upper stretch 48 and a lower stretch 50 with a bend 52 therebetween to present upper stretch 48 at an oblique angle relative to lower stretch 50 and thereby permit the operator to position the nozzle 18 behind the seat 24 and in front of the riser wall 30. In alternative embodiments for sloped floor seating, the wand 16 may be provided with a straight tubular material and the bend may be omitted. The normally lower end 54 of the wand 16 may be provided with a fitting 56 which receives lower stretch 50 therethrough and an externally threaded projection 58.

Nozzle 18 is connected to the fitting 56 by threaded nipple 60 and compression nut 62 which secures the shroud 20 therebetween. The nipple 60 is rotatably received on inlet 64 of housing 66. Pressurized air is passed through wand 16 into nozzle 18 through tubular inlet 64. As shown in FIG. 3, housing 66 presents an intake end 68 having an inwardly narrowing frustoconical interior surface 70 and an internally threaded outlet end 72. The housing further presents an annular port 74 located downstream of the neck 76 of the frustoconical interior surface 70 which receives pressurized air from tubular inlet 64. Internally threaded outlet end 72 threadably receives insert 78. Insert 78 presents a hollow interior flow channel 80 having an upstream opening 82 with a diameter slightly larger than the diameter of neck 76 whereby air under pressure delivered from annular port 74 induces the flow of air through neck 76. Insert 78 also presents a hollow annular tip 84 at its downstream end 86 for directing the exiting stream 88 of air leaving the nozzle 18. The tip 84 defines the discharge 89 of the nozzle 18 whereby the stream 88 is directed substantially perpendicular to the axis of the lower stretch 50 of the wand 16. A portion of the outer surface of the insert 78 presents external threads 90 for adjusting the position of insert 78 relative to the housing 66 to regulate the amount of air passing through port 74. As shown in FIG. 4, another portion of the outer surface of the insert 78 adjacent the downstream end presents knurling 92 for aiding the turning of the insert 78 within the housing 66 and, if necessary, removing it for cleaning.

The shroud 20 presents a mounting flange 94 for positioning between the nipple 60 and the compression nut 62, the mounting flange 94 including a slot 96 for allowing the shroud 20 to be mounted between the wand 16 and the nozzle 18 without the necessity of removing the latter. The shroud 20 is curved at the normally lowermost portion 98 whereby the shroud 20 substantially surrounds the side of the housing 66 leaving the intake end 68 open to receive atmospheric air therethrough. As shown in FIG. 2, a gap 100 is presented along the length of the shroud 20 between the edge 102 of the shroud 20 and the mounting flange 94 to permit viewing of the relative position of the insert 78 within the housing. The annular tip 84 projects a short distance from the downstream margin 104 of the shroud 20 to facilitate the operator in seeing where the air stream 88 is being directed.

In use, the quick-connect fitting 36 is connected to conduit sweeping apparatus 10 is connected to conduit 21 for supplying pressurized air to the handle 16. The conduit 21 may be provided in sections and typically will range from about 100 feet to 500 feet in length, supplying air at about 80 psi at a volume of 3 lbs. of air per minute from a compressor or tank. The elongated thin wand permits the operator to stand substantially upright at one end of a row 22 of seats 24 and position the apparatus 10 so that the annular tip 84 is oriented to move along the row 22 either in front of or behind the seats 24. A complete pass along the length of the row 22 is made while the operator pulls on the trigger to direct air through the handle 14 to the wand 16 and then to the nozzle 18. The stream 88 leaves the tip 84 directed substantially horizontally to the landing 26 to blow any debris with a minimum amount of disturbance normally associated with a dispersed stream and a high angle of attack. The port 74 aspirates air through the intake end 68 so that the stream 88 has a flow volume of about 6 lbs. of air per minute. The operator may lock the trigger 34 open by pushing stop 42 upwardly to prevent the spring loaded trigger 34 from returning to a disengaged position.

After the operator passes along the front of the seats 24 in the row 22 and pushes all of the debris into an aisle, a second pass may be made behind the seats 24 along the row 22 by positioning the wand 16 between the backs of the seats 24 and the riser wall 30. The narrow clearance between the seats 24 and the riser wall 30 does not present a problem as the thin wand 16 permits passage of the apparatus 10 along the row 22 with the nozzle 18 positioned close to the landing 26. Additionally advantageous is that the operator may position the nozzle 18 in and around the seat mountings by turning the handle 14 as desired, thereby directing the stream 88 as desired. The shroud 20 is of steel or other hard material to protect the nozzle 18 from damage caused by impact with the landings 26 or 28 or the seats 24. Preferably, the shroud 20 is relatively short, such as only about 2 inches in length with the tip projecting less than an additional ½ inch, so that the nozzle 18 and shroud 20 have good maneuverability around the seats 24. After the return pass along the back side of the seats 24 in the row, with the debris blown into the aisle at the other end of the row 22, the operator moves to the next row of seats below first landing 28 until all of the rows are finished. It is then a relatively simple matter to use a broom or industrial vacuum to collect and remove the debris collected in the aisles.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of their invention as pertains to any apparatus not materially departing from but outside the literal scope of the invention as set out in the following claims.

We claim:

1. An apparatus for sweeping seating areas comprising:

a graspable handle having an outlet and an inlet fitting adapted for connection to a source of pressurized air;

an elongated thin tubular wand connected to said handle outlet for receiving pressurized air from said handle and extending from the outlet of the handle; and a nozzle connected to said wand and presenting an interior flow channel in fluidic communication with said wand, said channel having a discharge angularly oriented relative to the wand for directing a stream of air therefrom, wherein said nozzle presents an intake end in communication with the atmosphere and a nozzle inlet for connecting to said wand, whereby pressurized air passing through said handle and said wand into said nozzle aspirates additional air from said intake end for delivery to said discharge.

2. An apparatus as set forth in claim 1, wherein said nozzle includes an annular port for delivering air from said nozzle inlet into said channel.

3. An apparatus as set forth in claim 2, wherein said intake end presents a frustoconical interior surface narrowing to a neck, and wherein said annular port substantially surrounds said neck.

4. An apparatus as set forth in claim 3, wherein said nozzle includes a housing and an insert adjustably received in said housing, said housing including said intake end and said insert including said discharge.

5. An apparatus as set forth in claim 4, including a shroud mounted to said wand for protecting said nozzle.

6. An apparatus as set forth in claim 1, wherein said wand presents an upper stretch connected to said handle outlet and a lower stretch connected to said nozzle and oriented at an oblique angle to said upper stretch.

7. An apparatus for sweeping seating areas comprising:

a graspable handle having an outlet and an inlet fitting adapted for connection to a source of pressurized air;

an elongated thin tubular wand connected to said handle outlet for receiving pressurized air from said handle and extending from the outlet of the handle; and a nozzle connected to said wand and presenting an interior flow channel in fluidic communication with said wand, said channel having a discharge angularly oriented relative to the wand for directing a stream of air therefrom, said handle including a spring loaded trigger and a trigger guard, and further including a selectively engagable stop shiftably coupled to said trigger guard for maintaining said trigger in an actuated condition.

8. A method for sweeping seating areas having at least one row including a plurality of substantially linearly aligned seats located on a supporting surface comprising the steps of:

providing a sweeping apparatus having a handle, a thin elongated wand and a nozzle for directing a stream of air, said nozzle including an intake end in communication with the atmosphere and an inlet in fluidic communication with the wand;

connecting the sweeping apparatus to a source of pressurized air;

positioning the nozzle adjacent the supporting surface for the seats;

passing pressurized air through said wand into said nozzle through said inlet; and aspirating additional air into said nozzle through said intake end for directing a stream of air including both said pressurized air and said aspirated air substantially horizontally along the supporting surface to sweep debris on the supporting surface.

9. A method as set forth in claim 8, wherein said supporting surface includes first lower and second upper substantially horizontal landings at different levels and separated by substantially vertical riser walls, and including the step of positioning said wand between the riser walls and the seats and moving said nozzle along said row between said seats and said riser wall.

10. A method as set forth in claim 9, wherein said nozzle remains adjacent said wall and vertically below said second landing.

11. A method as set forth in claim 10, wherein the operator moves along the row in a standing, substantially upright position.

* * * * *